US006116878A

United States Patent [19]

Miura

[11] Patent Number: 6,116,878

[45] Date of Patent: Sep. 12, 2000

[54] OIL PUMP APPARATUS

[75] Inventor: Yoshinori Miura, Kariya, Japan

[73] Assignee: Aisen Seiki Kabushiki Kaisha, Aichi-ken, Japan

[21] Appl. No.: 09/086,713

[22] Filed: May 29, 1998

[30] Foreign Application Priority Data

May 29, 1997 [JP] Japan ..... 9-140570

[51] Int. Cl.[7] ..... F01C 1/10

[52] U.S. Cl. ..... 418/171; 418/166

[58] Field of Search ..... 418/171, 166, 418/102

[56] References Cited

U.S. PATENT DOCUMENTS 4,453,901 6/1984 Zimmerly .
5,215,165 6/1993 Torii .

FOREIGN PATENT DOCUMENTS 4425226 1/1996 Germany .

*Primary Examiner*—Hoang Nguyen
*Attorney, Agent, or Firm*—Reed Smith Hazel & Thomas LLP

[57] ABSTRACT

An oil pump apparatus incorporates a housing defining therein a generally cylindrical space, an outer rotor having a substantially cylindrical outer peripheral surface disposed in rotatably sliding contact with an inner peripheral surface of the cylindrical space, the outer rotor further having an inner peripheral surface formed thereon with a plurality of circumferentially equally spaced gear teeth, and a shaft rotatably mounted in the housing. The oil pump apparatus further includes an inner rotor having a plurality of projections for connecting to the shaft for rotation therewith and disposed facing inwardly on the inner peripheral surface of the inner rotor, the inner rotor being disposed in the substantially cylindrical space in the housing and having an outer peripheral surface formed thereon with a plurality of circumferentially equally spaced gear teeth disposed in partial meshing engagement with the gear teeth of the outer rotor so as to define a plurality of working chambers between the gear teeth of the inner rotor and the outer rotor.

8 Claims, 3 Drawing Sheets

OIL PUMP APPARATUS

BACKGROUND OF THE INVENTION

1. Field of the Invention

The present invention generally relates to an oil pump apparatus. More particularly, the present invention relates to an oil pump apparatus including an inner and outer rotor which are disposed in a housing and including a shaft connected to the inner rotor to rotate the outer rotor.

2. Background of the Invention

The type of an oil pump apparatus is described in Japanese unexamined Patent Publication No. Shou. 63-223382. This apparatus includes an inner rotor, an outer rotor, a housing and a crank shaft. The inner rotor is formed in a ring shape, and rotational force is transmitted from the crank shaft. Further, the inner rotor has a ring shaped projection at the inner peripheral surface. The projection of the inner rotor extends along the outer peripheral surface of the crank shaft. The housing includes a receiving position which receives the projection of the inner rotor so as to set a position of the inner rotor. Therefore, the precise manufacturing of the inner rotor and the housing are required.

Because the projection of the inner rotor slides toward the housing and is pressed against the housing, there is rotational resistance between the projection of the inner rotor and the receiving position of the housing. This results in problems due to the wearing out of the receiving position of the housing.

SUMMARY OF THE INVENTION

The present invention provides an oil pump apparatus comprising a housing defining therein a generally cylindrical space, an outer rotor having a substantially cylindrical outer peripheral surface disposed in rotatably sliding contact with an inner peripheral surface of the cylindrical space, the outer rotor further having an inner peripheral surface formed thereon with a plurality of circumferentially equally spaced gear teeth, a shaft rotatably mounted in the housing, and an inner rotor having a plurality of projections for connecting to the shaft for rotation therewith and disposed facing inwardly on the inner peripheral surface of the inner rotor, the inner rotor being disposed in the substantially cylindrical space in the housing and having an outer peripheral surface formed thereon with a plurality of circumferentially equally spaced gear teeth disposed in partial meshing engagement with the gear teeth of the outer rotor so as to define a plurality of working chambers between the gear teeth of the inner rotor and the outer rotor.

BRIEF DESCRIPTION OF THE DRAWINGS

Additional details and features of the present invention will become clear from the following description and from the following detailed drawings in which like numerals refer to like parts and wherein.

DETAILED DESCRIPTION OF THE PREFERRED EMBODIMENT

The preferred embodiment of the present invention will be explained below based on the drawings.

Figure 1:
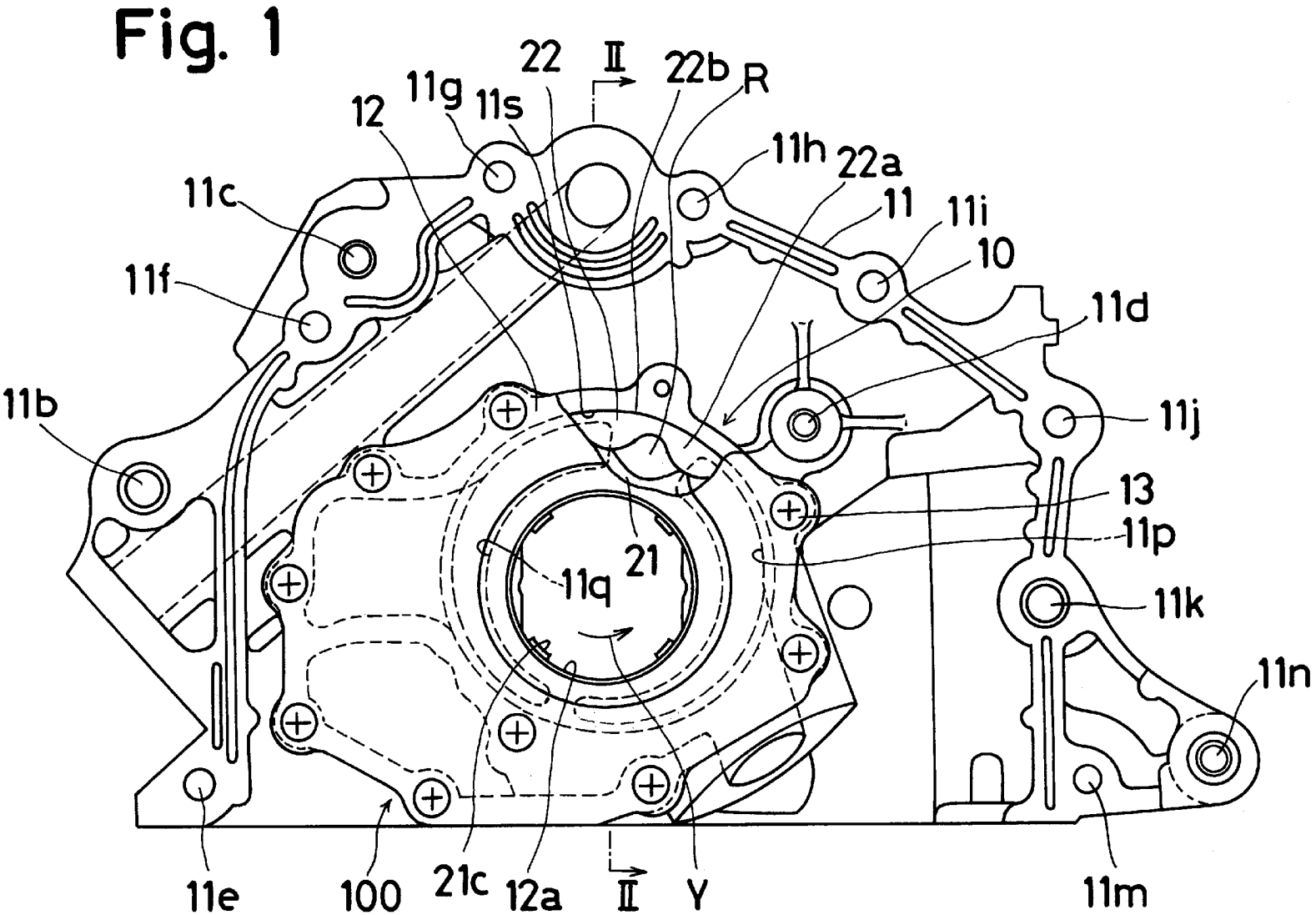
FIG. 1 is a front view of an oil pump apparatus in accordance with the preferred embodiment of the present invention.
Figure 2:
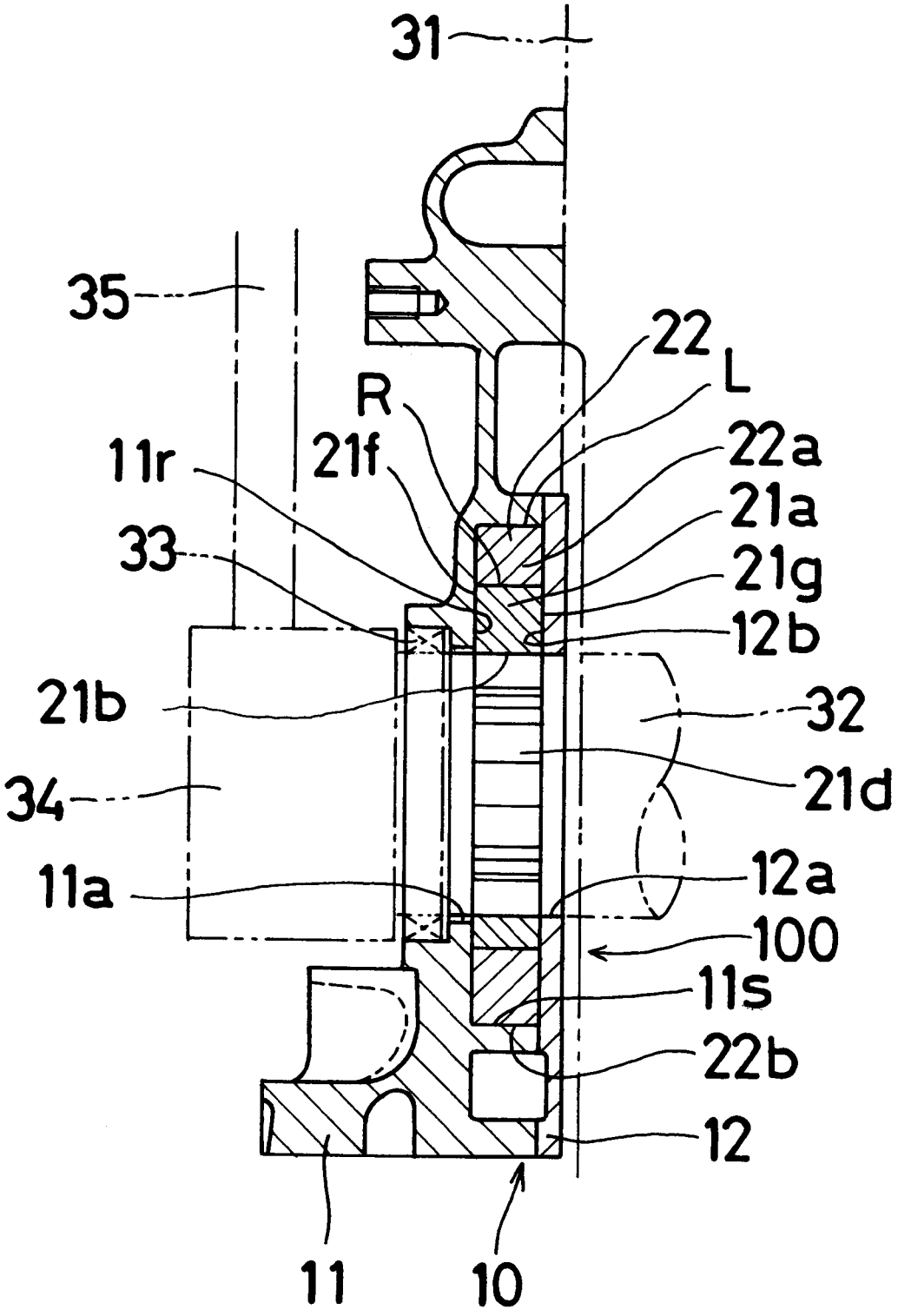
FIG. 2 is a cross-sectional view taken along line II—II of FIG. 1.

FIGS. 1 and 2 show a structure of an oil pump apparatus 100. FIG. 1 is a front view of the oil pump apparatus 100. The oil pump apparatus 100 includes a housing 10, an inner rotor 21 and an outer rotor 22. The housing 10 includes a body 11 and a cover 12. The body 11 has a cylindrical concave portion 11*s*. The inner rotor 21 and the outer rotor 22 are disposed into the cylindrical, concave portion 11*s* of the housing 10.

As shown in FIG. 2, the oil pump apparatus 100 is located on the side end of an engine block 31 and is rotatably driven by a crank shaft 32. An oil seal 33 is located between the outer peripheral surface of the crank shaft 32 and the body 11 of the housing 10. At the end of the crank shaft 32, a crank pulley 34 is attached. The crank pulley 34 drives a timing belt 35 to drive a cam shaft and a water pump apparatus (not shown).

The cover 12 is fixed to the body 11 by ten flat-head screws 13. The body 11 and the cover 12 has holes 11*a* and 12*a*, respectively. The crank shaft 32 rotatably penetrates the holes 11*a* and 12*a* of the housing 10. The body 11 has two attaching holes 11*b* and 11*k* into which a pin (not shown) of the engine block 31 is inserted, and has nine installing holes 11*c*, 11*d*, 11*e*, 11*f*, 11*g*, 11*h*, 11*i*, 11*j*, 11*m* into which bolts (not shown) are inserted for connecting the body 11 of the housing 10 to the engine block 31. The body further has n hole 11*n* into which installing a bolt (not shown) is inserted for attaching an auxiliary apparatus such as a water pump, an alternator or a pump for power steering (not shown). The cylindrical concave portion 11*s* of the body 11 includes a suction port 11*p* and a discharge port 11*q*.

Figure 3:
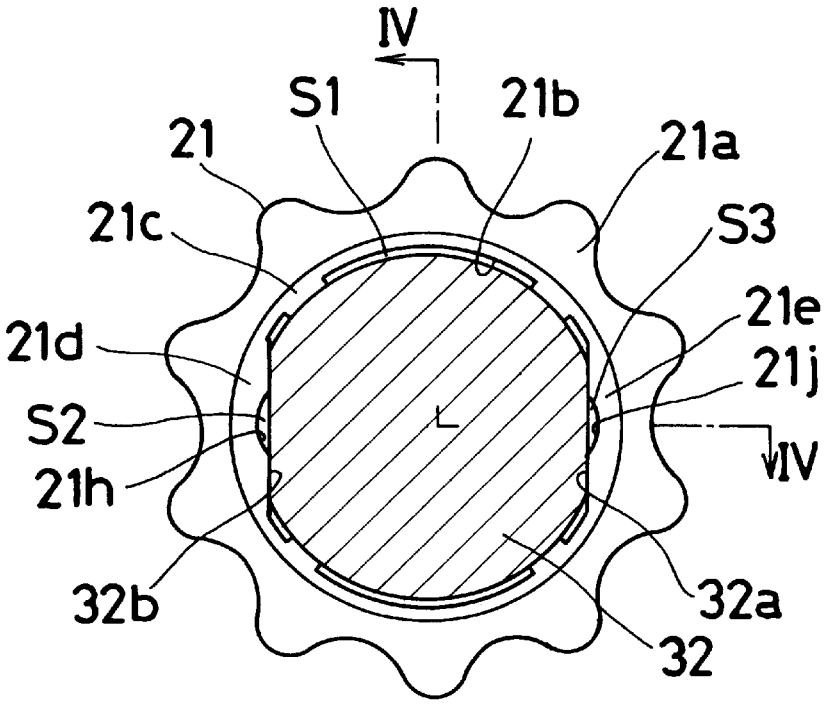
FIG. 3 is a front view of an inner rotor in accordance with the preferred embodiment of the present invention.
Figure 4:
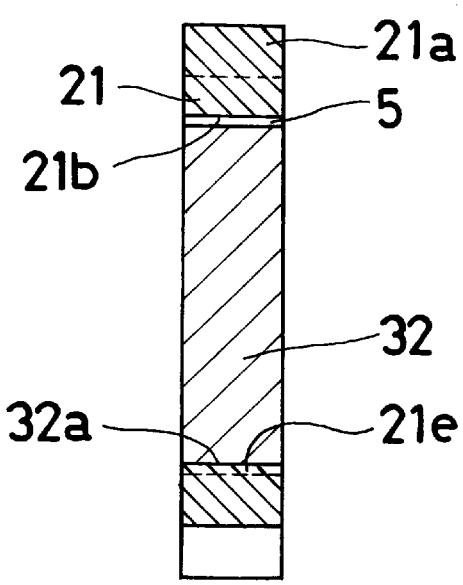
FIG. 4 is a cross-sectional view taken along line IV—IV of FIG. 3.

As shown in FIG. 1 and FIG. 3, the inner rotor 21 has ten external gear teeth 21*a* on the outer peripheral surface of the inner rotor 21 and an inner hole 21*b*. The inner hole 21*b* includes four projections 21*c* for supporting the outer surface of the crank shaft 32. Each projection 21*c* extends to the center of the inner rotor 21 in the radius direction, respectively. The projections 21*c* are equidistantly located on the inside circumference of the inner rotor 21. Thereby, there is the oil passage S1 between the outer peripheral surface of the crank shaft 32 and the inner peripheral surface of the inner rotor 21, as shown in FIG. 3. The width of the oil passage S1 is about 0.2 millimeter. Further, the inner hole 21*b* has a pair of projectional members 21*d* and 21*e*. On the other hand, the crank shaft 32 has a pair of plane surfaces 32*a* and 32*b* on the outer surface of the crank shaft 32. The projectional members 21*d* and 21*e* are respectively engaged with the plane surfaces 32*a* and 32*b* so as to prevent the inner rotor 21 from sliding towards the crank shaft 32. As shown in FIG. 3, the projectional members 21*d* has a concave ditch 21*h* and the projectional members 21*e* has a concave ditch 21*j*. The clearance S2 between the concave ditch 21*h* and the plane surface 32*b* is provided for an oil passage. The clearance S3 between the concave ditch 21*j* and the plane surface 32*a* is provided for another oil passage. As shown in FIG. 2, the side surface 21*f* of the inner rotor 21 slidably contacts a bottom surface 11*r* of the cylindrical concave portion 11*s* of the body 11. The side surface 21*g* of the inner rotor 21 slidably contacts an inside surface 12*b* of the cover 12.

The outer rotor 22 is located in the cylindrical concave portion 11*s* of the body 11. The center axis of the outer rotor 22 and the center axis of the inner rotor 21 are displaced with a predetermined distance. The outer rotor 22 has eleven internal gear teeth 22*a* on the inner peripheral surface of the outer rotor 22. The internal gear teeth 22*a* engage the external gear teeth 21*a* of the inner rotor 21 so as to make a plurality of pump chamber R. The external gear teeth 21*a* of the inner rotor 21 and the internal gear teeth 22*a* of the outer rotor 22 are designed to be a trochoid curve. There is some clearance L between the outer peripheral surface of the outer rotor 22 and the inner peripheral surface of the cylindrical concave portion 11*s*. The clearance L is about 0.3 millimeter. The clearance L absorbs the rotational shaking of the crank shaft 32.

The operation of the above explained oil pump apparatus will be hereinafter described.

The inner rotor 21 is connected to the crank shaft 32, and is rotated together with the crank shaft 32. The inner rotor 21 is rotated in the direction of the arrow Y of FIG. 1. As the inner rotor 21 is rotated, the external gear teeth 21*a* of the inner rotor 21 engage with the internal gear teeth 22*a* of the outer rotor 22 one after another. Accordingly, the outer rotor 22 is rotated in the same direction. Between the internal gear teeth 22*a* and the external gear teeth 21*a*, chambers R are formed as shown in FIG. 1. The chambers R operate to suck the hydraulic oil from the suction port 11*p* and acts to discharge the hydraulic oil to the discharge port 11*q*, when both the inner rotor 21 and the outer rotor 22 are rotated. The crank shaft 32, the inner rotor 21 and the outer rotor 22 may be shaken when they rotate. This is caused because, for example, the crank shaft 32 may not be perfectly straight or the oil pump apparatus 100 itself may not be placed perfectly or the crank shaft 32 may not be perfectly in place. However, the clearance L absorbs the shaking. In addition, when both the inner rotor 21 and the outer rotor 22 are rotated, the hydraulic oil leaks from the chambers R through the clearance between the side surface 21*f* of the inner rotor 21 and bottom surface 11*r* of the cylindrical concave portion 11*s* of the body 11, or the clearance between the side surface 21*g* of the inner rotor 21 and inside surface 12*b* of the cover 12. The leaked hydraulic oil returns into the engine block 31 through the passages S1, S2 and S3.

While the invention has been particularly shown and described with reference to the preferred embodiment thereof, it will be understood by those skilled in the art that the foregoing and other changes in form and details can be made therein without departing from the spirit and scope of the invention.

What is claimed is:

1. An oil pump apparatus comprising:

a housing defining therein a generally cylindrical space;

an outer rotor having a substantially cylindrical outer peripheral surface disposed in rotatably sliding contact with an inner peripheral surface of the cylindrical space, the outer rotor further having an inner peripheral surface formed thereon with a plurality of circumferentially equally spaced gear teeth;

a shaft rotatably mounted in the housing; and an inner rotor having a plurality of projections for supporting the outer peripheral surface of the shaft and disposed facing inwardly on the inner peripheral surface of the inner rotor, the inner rotor being disposed in the substantially cylindrical space in the housing and having an outer peripheral surface formed thereon with a plurality of circumferentially equally spaced gear teeth disposed in partial meshing engagement with the gear teeth of the outer rotor so as to define a plurality of working chambers between the gear teeth of the inner rotor and the outer rotor.

2. An oil pump apparatus of claim 1, wherein the projections located on the inner rotor are located on the substantially inner peripheral surface of the inner rotor.

3. An oil pump apparatus of claim 2, wherein the projections located on the inner rotor are equidistantly located on the inside circumference of the inner rotor.

4. An oil pump apparatus of claim 2, wherein two pairs of symmetrical projections arranged such that the four projections are equidistantly located on the inside circumference of the inner rotor.

5. An oil pump apparatus of claim 1, further comprising:

at least one oil passage formed between the outer peripheral surface of the shaft and the inner peripheral surface of the inner rotor.

6. An oil pump apparatus of claim 1, further comprising:

clearance between an outer peripheral surface of the outer rotor and the cylindrical space of the housing.

7. An oil pump apparatus comprising:

a housing defining therein a generally cylindrical space;

an outer rotor having a substantially cylindrical outer peripheral surface disposed in rotatably sliding contact with an inner peripheral surface of the cylindrical space, the outer rotor further having an inner peripheral surface formed thereon with a plurality of circumferentially equally spaced gear teeth;

a shaft rotatably mounted in the housing; and an inner rotor having a plurality of inward projections for supporting the outer surface of the shaft, and at least one projectional member engaged with a plane surface on said outer surface of the shaft, being disposed in the substantially cylindrical space in the housing and having an outer peripheral surface formed thereon with a plurality of circumferentially equally spaced gear teeth disposed in partial meshing engagement with the gear teeth of the outer rotor so as to define a plurality of working chambers between the gear teeth of the inner rotor and the outer rotor.

8. An oil pump apparatus of claim 7, wherein each said projectional member is provided with a concave ditch so as to provide an oil passage formed between the concave ditch and the plane surface.

* * * * *

UNITED STATES PATENT AND TRADEMARK OFFICE

CERTIFICATE OF CORRECTION

PATENT NO. :6,116,878
DATED : September 12, 2000
INVENTOR(S) : Miura

It is certified that error appears in the above-identified patent and that said Letters Patent is hereby corrected as shown below.

Title page,
Item [73 ], please delete "Aisen" and insert --Aisin--

Signed and Sealed this

First Day of May, 2001

*Attest:*

Nicholas P. Godici

NICHOLAS P. GODICI

*Attesting Officer*

*Acting Director of the United States Patent and Trademark Office*